US011322093B2

(12) United States Patent
Park et al.

(10) Patent No.: US 11,322,093 B2
(45) **Date of Patent: *May 3, 2022**

(54) PIXEL CIRCUIT AND DISPLAY APPARATUS HAVING THE SAME

(71) Applicant: Samsung Display Co., Ltd., Yongin-Si (KR)

(72) Inventors: Jun Hyun Park, Suwon-si (KR); Chong Chui Chai, Seoul (KR); Young Wan Seo, Suwon-si (KR); An Su Lee, Seoul (KR); Bo Yong Chung, Suwon-si (KR); Kang Moon Jo, Hwaseong-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/062,971

(22) Filed: Oct. 5, 2020

(65) Prior Publication Data

US 2021/0125560 A1 Apr. 29, 2021

(30) Foreign Application Priority Data

Oct. 24, 2019 (KR) ..... 10-2019-0132744

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3233; G09G 3/3258; G09G 2300/0809; G09G 2300/0819;
(Continued)

(56) References Cited

U.S. PATENT DOCUMENTS 9,786,222 B2 * 10/2017 Lim ..... G09G 3/3233
10,650,738 B2 * 5/2020 Park ..... G09G 3/3233
(Continued)

FOREIGN PATENT DOCUMENTS

KR 101082234 B1 11/2011
KR 1020140123219 A 10/2014
(Continued)

*Primary Examiner* — Tom V Sheng
(74) *Attorney, Agent, or Firm* — Cantor Colburn LLP

(57) ABSTRACT

A pixel circuit includes a first switching element including a control electrode connected to a first node, an input electrode which receives a first power voltage and an output electrode connected to a third node, a second switching element including a control electrode which receives a compensation gate signal, an input electrode connected to a second node and an output electrode connected to the third node, a third switching element including a control electrode which receives a write gate signal, an input electrode connected to the first node and an output electrode connected to the second node, a storage capacitor including a first electrode which receives an initialization voltage and a second electrode connected to the first node, a program capacitor which receives a data voltage and connected to the second node, and an organic light emitting element connected to the third node and which receives a second power voltage.

20 Claims, 11 Drawing Sheets

(52) U.S. Cl.
CPC ..... *G09G 2300/0842* (2013.01); *G09G 2320/0209* (2013.01); *G09G 2330/028* (2013.01)

(58) Field of Classification Search
CPC ... G09G 2300/0842; G09G 2310/0251; G09G 2320/0209; G09G 2320/045; G09G 2330/028
USPC ..... 345/212
See application file for complete search history.

(56) References Cited

U.S. PATENT DOCUMENTS 10,706,755 B2 * 7/2020 Ju ..... H01L 51/0031
10,726,771 B2 * 7/2020 Zhou ..... G09G 3/32
2012/0146979 A1 * 6/2012 Kim ..... G09G 3/3233 345/211
2013/0002616 A1 * 1/2013 Kim ..... G09G 3/325 345/204
2017/0124954 A1 * 5/2017 Park ..... H01L 27/3244
2018/0342195 A1 * 11/2018 Zhou ..... G09G 3/22
2019/0206316 A1 * 7/2019 Park ..... G09G 3/3225
2020/0051472 A1 * 2/2020 Ju ..... H01L 51/0031
2021/0049959 A1 * 2/2021 Park ..... G09G 3/325
2021/0056895 A1 * 2/2021 Lee ..... G09G 3/3266

FOREIGN PATENT DOCUMENTS

KR 1020180093147 A 8/2018
KR 1020190012303 A 2/2019
KR 101964768 B1 4/2019

* cited by examiner

PIXEL CIRCUIT AND DISPLAY APPARATUS HAVING THE SAME

This application claims priority to Korean Patent Application No. 10-2019-0132744, filed on Oct. 24, 2019, and all the benefits accruing therefrom under 35 U.S.C. § 119, the content of which in its entirety is herein incorporated by reference.

BACKGROUND

1. Field

Exemplary embodiments of the invention relate to a pixel circuit and a display apparatus including the pixel circuit. More particularly, exemplary embodiments of the invention relate to a pixel circuit for a high resolution and a display apparatus including the pixel circuit.

2. Description of the Related Art

Generally, a display apparatus includes a display panel and a display panel driver. The display panel typically includes a plurality of gate lines, a plurality of data lines and a plurality of pixels. The display panel driver typically includes a gate driver, a data driver and a driving controller. The gate driver outputs gate signals to the gate lines. The data driver outputs data voltages to the data lines. The driving controller controls the gate driver and the data driver.

SUMMARY

A conventional pixel circuit typically include a number of transistors so that the conventional pixel circuits may not be effectively used for a high resolution display panel is the number of the transistor is too great. In addition, when the number of the transistors is reduced for the high resolution, a color difference between upper and lower portions and a crosstalk may occur.

Exemplary embodiments of the invention provide a pixel circuit including a reduced number of transistors and for enhancing a display quality of a display panel.

Exemplary embodiments of the invention also provide a display apparatus including the pixel circuit.

In an exemplary embodiment according to the invention, a pixel circuit includes a first switching element including a control electrode connected to a first node, an input electrode which receives a first power voltage and an output electrode connected to a third node, a second switching element including a control electrode which receives a compensation gate signal, an input electrode connected to a second node and an output electrode connected to the third node, a third switching element including a control electrode which receives a write gate signal, an input electrode connected to the first node and an output electrode connected to the second node, a storage capacitor comprising a first electrode which receives an initialization voltage and a second electrode connected to the first node, a program capacitor comprising a first electrode which receives a data voltage and a second electrode connected to the second node, and an organic light emitting element including a first electrode connected to the third node and a second electrode which receives a second power voltage.

In an exemplary embodiment, the first switching element, the second switching element and the third switching element may be P-type transistors.

In an exemplary embodiment, during an on bias period, the first switching element may be turned on, the second switching element may be turned off, the third switching element may be turned off, the first power voltage may have a high level, the second power voltage may have a high level, and the initialization voltage may have a low level.

In an exemplary embodiment, during an initialization period subsequent to the on bias period, the first switching element may be turned on, the second switching element may be turned on, the third switching element may be turned on, the first power voltage may have a low level, the second power voltage may have the high level, and the initialization voltage may have the low level.

In an exemplary embodiment, during a threshold voltage compensation period subsequent to the initialization period, the first switching element may be turned on, the second switching element may be turned on, the third switching element may be turned on, the first power voltage may have the high level, the second power voltage may have the high level, and the initialization voltage may have a high level.

In an exemplary embodiment, during a programming period subsequent to the threshold voltage compensation period, the first switching element may be turned on, the second switching element may be turned off, the third switching element may be turned on, the first power voltage may have the low level, the second power voltage may have the high level, and the initialization voltage may have the high level.

In an exemplary embodiment, during a pre-emission anode initialization period subsequent to the programming period, the first switching element may be turned on, the second switching element may be turned off, the third switching element may be turned off, the first power voltage may have the low level, the second power voltage may have the high level, and the initialization voltage may have the low level.

In an exemplary embodiment, during an emission period subsequent to the pre-emission anode initialization period, the first switching element may be turned on, the second switching element may be turned off, the third switching element may be turned off, the first power voltage may have the high level, the second power voltage may have the low level and the initialization voltage may have the high level.

In an exemplary embodiment, during a first initialization period subsequent to the on bias period, the first switching element may be turned on, the second switching element may be turned on, the third switching element may be turned off, the first power voltage may have a low level, the second power voltage may have the high level, and the initialization voltage may have the low level. In such an embodiment, during a second initialization period subsequent to the first initialization period, the first switching element may be turned on, the second switching element may be turned on, the third switching element may be turned on, the first power voltage may have the low level, the second power voltage may have the high level, and the initialization voltage may have the low level.

In an exemplary embodiment, during an initialization period subsequent to the on bias period, the first switching element may be turned on, the second switching element may be turned on, the third switching element may be turned on, the first power voltage may have a low level, the second power voltage may have the high level and the initialization voltage may have the low level. In such an embodiment, the initialization voltage may temporarily have a high level at a boundary between the on bias period and the initialization period.

In an exemplary embodiment, a first initialization period subsequent to the on bias period, the first switching element may be turned on, the second switching element may be turned on, the third switching element may be turned off, the first power voltage may have a low level, the second power voltage may have the high level, and the initialization voltage may have the low level. In such an embodiment, during a second initialization period subsequent to the first initialization period, the first switching element may be turned on, the second switching element may be turned on, the third switching element may be turned on, the first power voltage may have the low level, the second power voltage may have the high level, and the initialization voltage may have the low level. In such an embodiment, the initialization voltage may temporarily have a high level at a boundary between the on bias period and the initialization period.

In an exemplary embodiment, the compensation gate signal may be a write gate signal of a different pixel.

In an exemplary embodiment, the first switching element, the second switching element and the third switching element may be N-type transistors.

In an exemplary embodiment, during an initialization period, the first switching element may be turned on, the second switching element may be turned on, the third switching element may be turned on and the first power voltage may have an intermediate level between a high level and a low level.

In an exemplary embodiment, during a threshold voltage compensation period subsequent to the initialization period, the first switching element may be turned on, the second switching element may be turned on, the third switching element may be turned on, the first power voltage may have the low level, and the initialization voltage may have a low level.

In an exemplary embodiment, during a programming period subsequent to the threshold voltage compensation period, the first switching element may be turned on, the second switching element may be turned off, the third switching element may be turned on, the first power voltage may have the high level, and the initialization voltage may have the low level.

In an exemplary embodiment, during an emission period subsequent to the programming period, the first switching element may be turned on, the second switching element may be turned off, the third switching element may be turned off, the first power voltage may have the high level, and the initialization voltage may have a high level.

In an exemplary embodiment, the compensation gate signal may be a write gate signal of a different pixel.

In an exemplary embodiment, the first switching element may be a P-type transistor, and the second switching element and the third switching element may be N-type transistors.

In an exemplary embodiment of a display apparatus according to the invention, the display apparatus includes a display panel, a gate driver and a data driver. In such an embodiment, the display panel includes a plurality of pixels. In such an embodiment, the gate driver outputs a write gate signal to the pixel. In such an embodiment, the data driver outputs a data voltage to the pixel. In such an embodiment, A pixel of the pixels includes a first switching element including a control electrode connected to a first node, an input electrode which receives a first power voltage and an output electrode connected to a third node, a second switching element including a control electrode which receives a compensation gate signal, an input electrode connected to a second node and an output electrode connected to the third node, a third switching element including a control electrode which receives a write gate signal, an input electrode connected to the first node and an output electrode connected to the second node, a storage capacitor including a first electrode which receives an initialization voltage and a second electrode connected to the first node, a program capacitor comprising a first electrode which receives a data voltage and a second electrode connected to the second node, and an organic light emitting element including a first electrode connected to the third node and a second electrode which receives a second power voltage.

According to exemplary embodiment of the pixel circuit and the display apparatus includes a pixel circuit including three transistors and two capacitors so that the display panel may have a high resolution.

In such embodiments, the driving signal of the pixel circuit including three transistors and two capacitors may be controlled in a way such that the color difference between upper and lower portions and the crosstalk may be reduced or prevented without increasing the number of the transistors in the pixel circuit. Thus, the display quality of the display panel may be enhanced.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
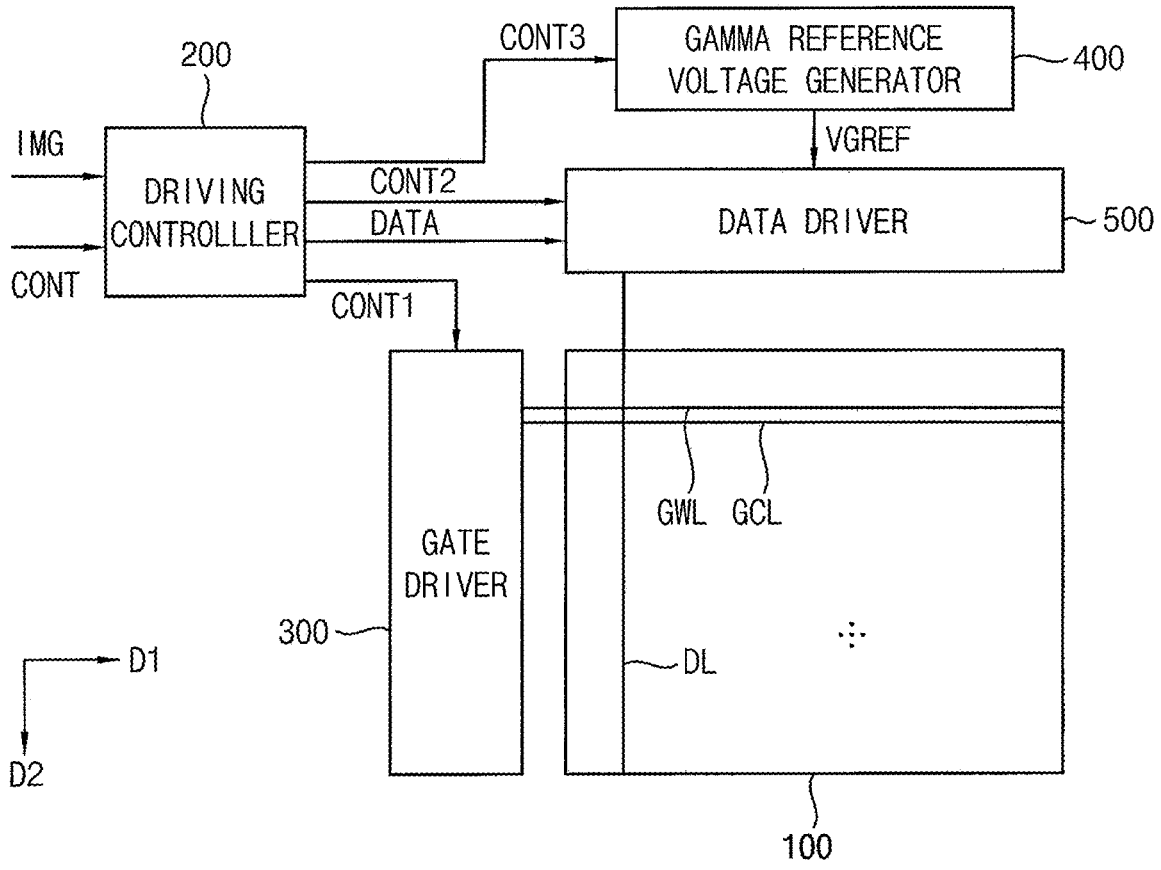
FIG. 1 is a block diagram illustrating a display apparatus according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be explained in detail with reference to the accompanying drawings.

FIG. 1 is a block diagram illustrating a display apparatus according to an exemplary embodiment of the invention.

Referring to FIG. 1, an exemplary embodiment of the display apparatus includes a display panel 100 and a display panel driver. The display panel driver includes a driving controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines GWL and GCL, a plurality of data lines DL and a plurality of pixels electrically connected to the gate lines GWL and GCL and the data lines DL. The gate lines GWL and GCL extend in a first direction D1 and the data lines DL extend in a second direction D2 crossing the first direction D1.

The driving controller 200 receives input image data IMG and an input control signal CONT from an external apparatus (not shown). In one exemplary embodiment, for example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GWL and GCL in response to the first control signal CONT1 received from the driving controller 200. The gate driver 300 may sequentially output the gate signals to the gate lines GWL and GCL. In one exemplary embodiment, for example, the gate driver 300 may be integrated on the display panel 100. In one exemplary embodiment, for example, the gate driver 300 may be mounted on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
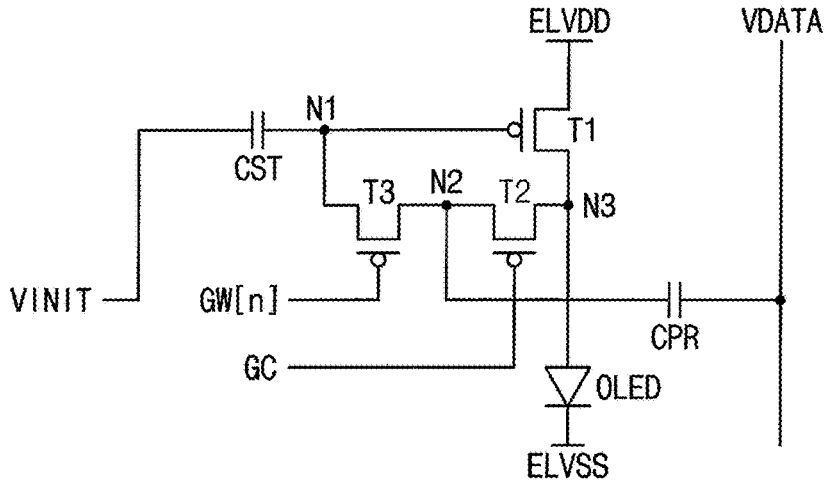
FIG. 2 is a circuit diagram illustrating a pixel of a display panel of FIG. 1.
Figure 3:
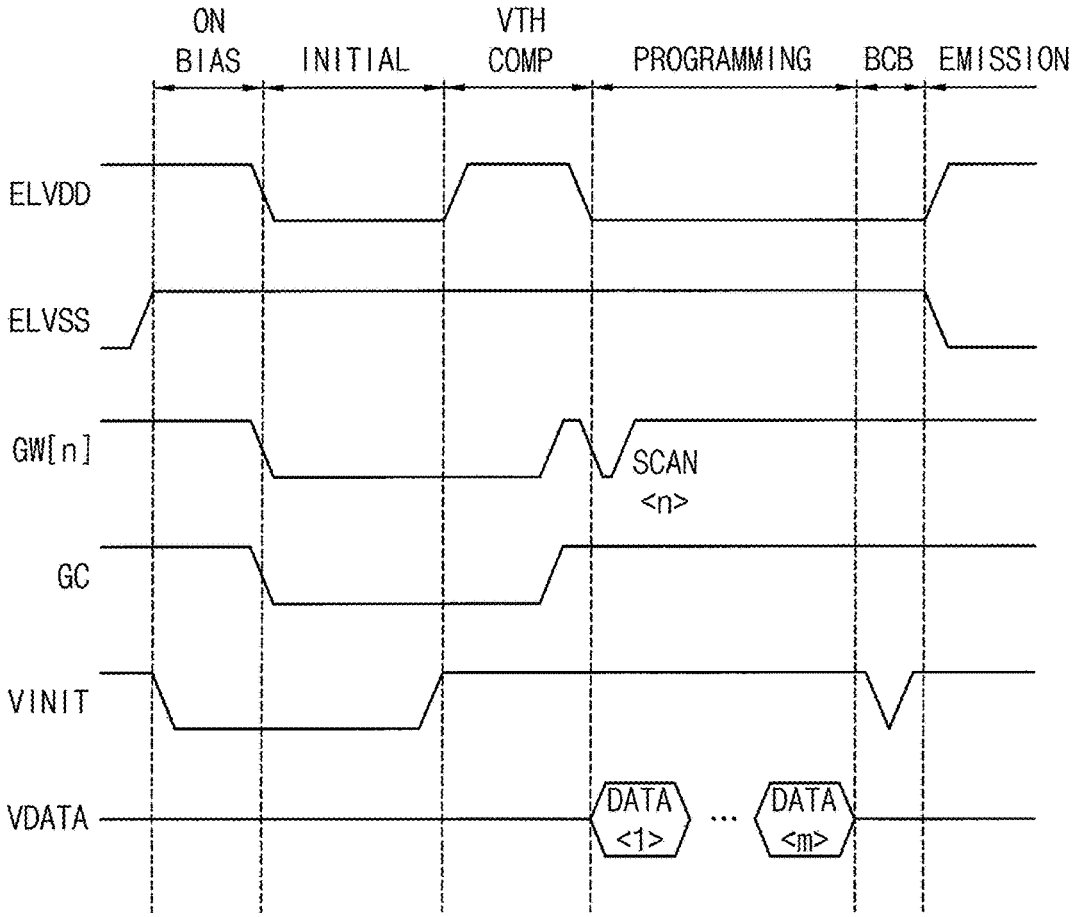
FIG. 3 is a timing diagram illustrating input signals applied to the pixel of FIG. 2.
Figure 4:
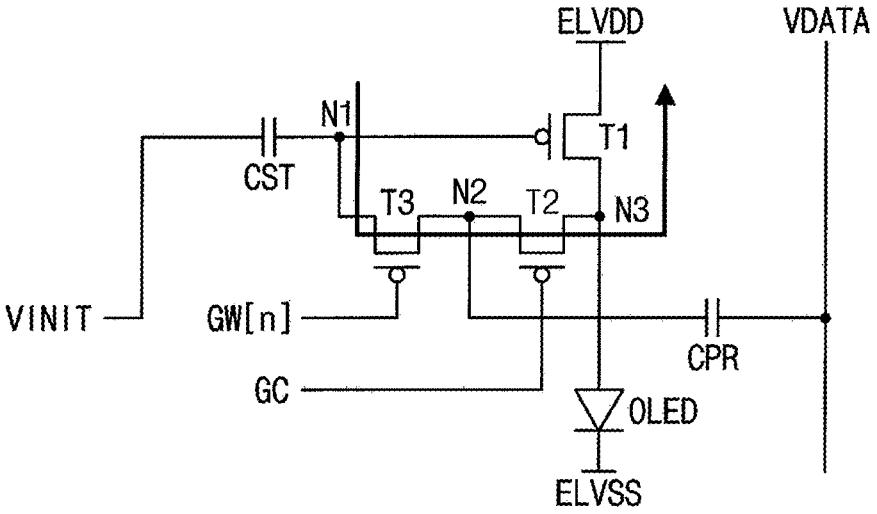
FIG. 4 is a circuit diagram illustrating the pixel of FIG. 2 in an initialization period of FIG. 3.
Figure 5:
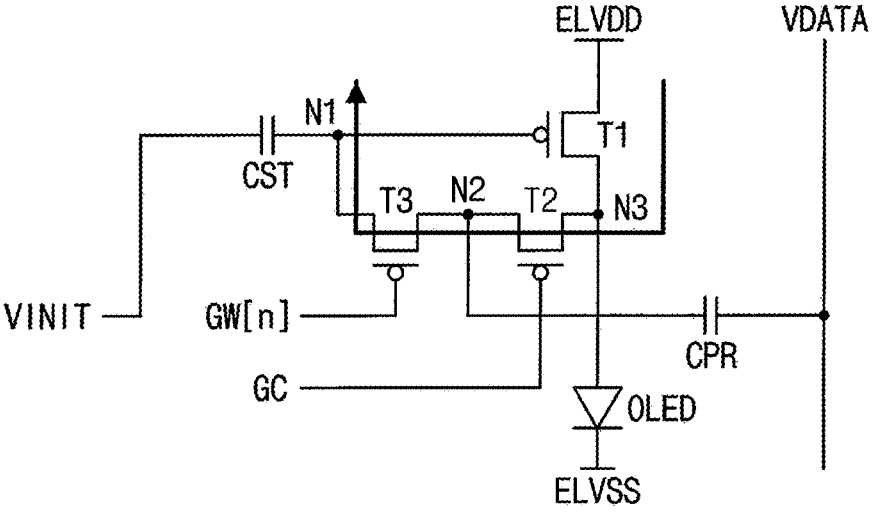
FIG. 5 is a circuit diagram illustrating the pixel of FIG. 2 in a threshold voltage compensation period of FIG. 3.
Figure 6:
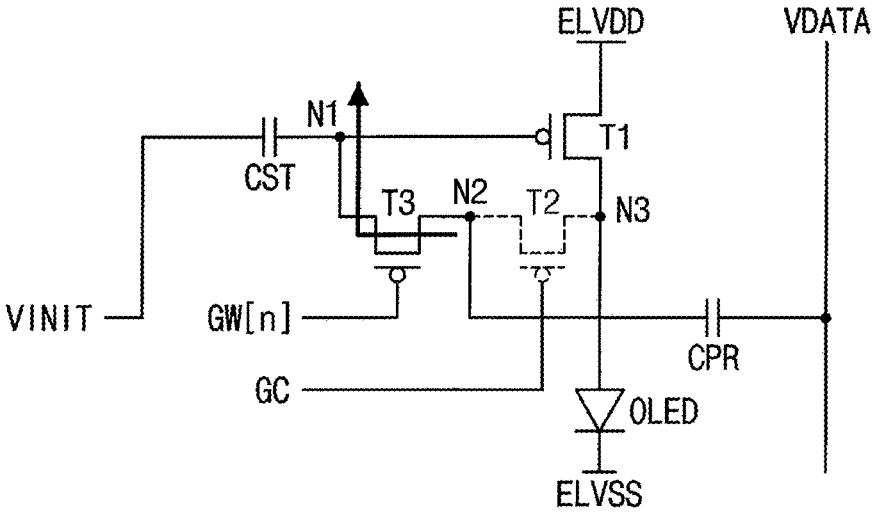
FIG. 6 is a circuit diagram illustrating the pixel of FIG. 2 in a programming period of FIG. 3.
Figure 7:
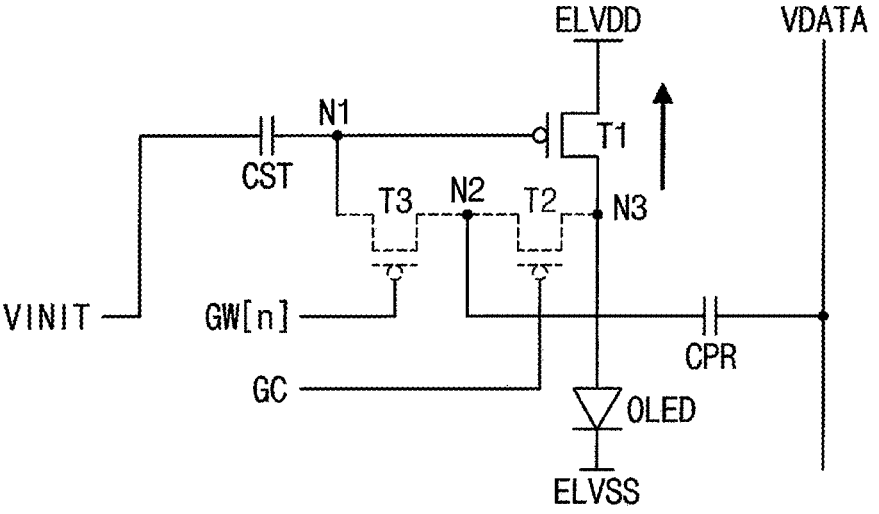
FIG. 7 is a circuit diagram illustrating the pixel of FIG. 2 in an anode initialization period of FIG. 3.
Figure 8:
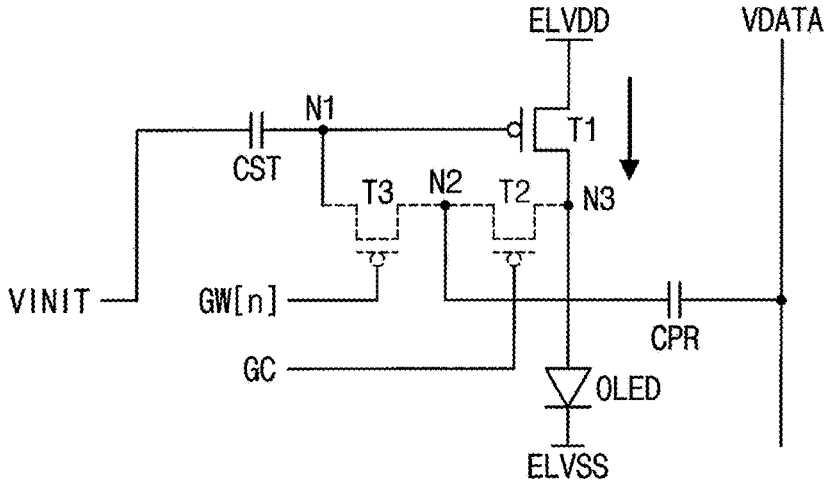
FIG. 8 is a circuit diagram illustrating the pixel of FIG. 2 in an emission period of FIG. 3.

FIG. 2 is a circuit diagram illustrating a pixel of the display panel 100 of FIG. 1. FIG. 3 is a timing diagram illustrating input signals applied to the pixel of FIG. 2. FIG. 4 is a circuit diagram illustrating the pixel of FIG. 2 in an initialization period INITIAL of FIG. 3. FIG. 5 is a circuit diagram illustrating the pixel of FIG. 2 in a threshold voltage compensation period VTH COMP of FIG. 3. FIG. 6 is a circuit diagram illustrating the pixel of FIG. 2 in a programming period PROGRAMMING of FIG. 3. FIG. 7 is a circuit diagram illustrating the pixel of FIG. 2 in an anode initialization period BCB of FIG. 3. FIG. 8 is a circuit diagram illustrating the pixel of FIG. 2 in an emission period EMISSION of FIG. 3.

Referring to FIGS. 1 to 8, the display panel 100 includes the plurality of pixels. Each pixel includes an organic light emitting element OLED.

The pixels receive a write gate signal GW, a compensation gate signal GC, the data voltage VDATA and an initialization voltage VINIT, a first power voltage ELVDD and a second power voltage ELVSS, and the organic light emitting elements OLED of the pixels emit light corresponding to the level of the data voltage VDATA to display the image.

In such an embodiment, the write gate signal GW[n] may be a local signal having a predetermined phase for a corresponding pixel row, e.g., an n-th pixel row. Herein, n is a natural number. In such an embodiment, the compensation gate signal GC may be a common signal commonly applied to all of the pixel rows.

In an exemplary embodiment, as described above, a pixel of the pixels, e.g., a pixel in the n-th row, may include first to third pixel switching elements T1, T2 and T3, a storage capacitor CST, a program capacitor CPR and the organic light emitting element OLED.

In an exemplary embodiment, as shown in FIG. 2, the first to third switching elements T1, T2 and T3 may be P-type transistors. In one exemplary embodiment, for example, the first to third switching elements T1, T2 and T3 may be polysilicon thin film transistors.

The first switching element T1 may include a control electrode connected to a first node N1, an input electrode which receives the first power voltage ELVDD and an output electrode connected to a third node N3. The control electrode of the first switching element T1 may be a gate electrode, the input electrode of the first switching element T1 may be a source electrode, and the output electrode of the first switching element T1 may be a drain electrode.

The second switching element T2 may include a control electrode which receives the compensation gate signal GC, an input electrode connected to a second node N2 and an output electrode connected to the third node N3. The control electrode of the second switching element T2 may be a gate electrode, the input electrode of the second switching element T2 may be a source electrode, and the output electrode of the second switching element T2 may be a drain electrode.

The third switching element T3 may include a control electrode which receives the write gate signal GW, an input electrode connected to the first node N1 and an output electrode connected to the second node N2. The control electrode of the third switching element T3 may be a gate electrode, the input electrode of the third switching element T3 may be a source electrode, and the output electrode of the third switching element T3 may be a drain electrode.

The storage capacitor CST may include a first electrode which receives the initialization voltage VINT and a second electrode connected to the first node N1.

The program capacitor CPR may include a first electrode which receives the data voltage VDATA and a second electrode connected to the second node N2.

The organic light emitting element OLED may include a first electrode connected to the third node N3 and a second electrode which receives the second power voltage ELVSS. The first electrode of the organic light emitting element OLED may be an anode electrode. The second electrode of the organic light emitting element OLED may be a cathode electrode.

In an exemplary embodiment, as shown in FIGS. 2 and 3, during an on bias period ON BIAS, the first switching element T1 may be turned on, the second switching element T2 may be turned off, the third switching element T3 may be turned off, the first power voltage ELVDD may have a high level, the second power voltage ELVSS may have a high level, and the initialization voltage VINIT may have a low level.

During the on bias period ON BIAS, the write gate signal GW[n] may have a high level and the compensation gate signal GC may have a high level.

During the on bias period ON BIAS, on bias may be applied to the first switching element T1 to enhance hysteresis. In addition, during the on bias period ON BIAS, the second power voltage ELVSS may have the high level to prevent emission of the organic light emitting element OLED due to turn-on of the first switching element T1.

In an exemplary embodiment, as shown in FIGS. 3 and 4, during an initialization period INITIAL subsequent to the on bias period ON BIAS, the first switching element T1 may be turned on, the second switching element T2 may be turned on, the third switching element T3 may be turned on, the first power voltage ELVDD may have a low level, the second power voltage ELVSS may have the high level, and the initialization voltage VINIT may have the low level.

During the initialization period INITIAL, the write gate signal GW[n] may have a low level and the compensation gate signal GC may have a low level.

During the initialization period INITIAL, the first node N1 connected to the control electrode of the first switching element T1 may be initialized using the initialization voltage VINIT. During the initialization period INITIAL, the voltage at the first node N1 may be ELVDD_L+a, where ELVDD_L denotes the low level of the first power voltage ELVDD, and a denotes a voltage generated by charge sharing when the write gate signal GW[n] is activated in the low level.

In an exemplary embodiment, as shown in FIGS. 3 and 5, during a threshold voltage compensation period VTH COMP subsequent to the initialization period INITIAL, the first switching element T1 may be turned on, the second switching element T2 may be turned on, the third switching element T3 may be turned on, the first power voltage ELVDD may have the high level, the second power voltage ELVSS may have the high level and the initialization voltage VINIT may have a high level.

During the threshold voltage compensation period VTH COMP, the write gate signal GW[n] may have the low level and the compensation gate signal GC may have the low level.

During the threshold voltage compensation period VTH COMP, the first power voltage ELVDD has the high level so that the threshold voltage (denoted by |VTH|) of the first switching element T1 may be compensated using a diode connection of the first switching element T1. During the threshold voltage compensation period VTH COMP, the voltage at the first node N1 may be ELVDD_H-|VTH|. Herein, ELVDD_H denotes the high level of the first power voltage ELVDD.

In an exemplary embodiment, as shown in FIGS. 3 and 6, during a programming period PROGRAMMING subsequent to the threshold voltage compensation period VTH COMP, the first switching element T1 may be turned on, the second switching element T2 may be turned off, the third switching element T3 may be turned on, the first power voltage ELVDD may have the low level, the second power voltage ELVSS may have the high level and the initialization voltage VINIT may have the high level.

During the programming period PROGRAMMING, the write gate signal GW[n] may sequentially have a low level according to scanning of the pixels in pixel rows in the display panel 100 and the compensation gate signal GC may have the high level. In FIG. 3, the write gate signal GW[n] is represented as a scan signal SCAN<n> of an n-th pixel row.

During the programming period PROGRAMMING, the data voltage VDATA is applied to the pixel through the data line DL. In FIG. 3, the number of the pixel rows may be m (here, m is a natural number greater than 1) so that the data voltage VDATA may include first to m-th grayscale voltages DATA<1> to DATA<m>.

During the programming period PROGRAMMING, the third switching element T3 may be turned on so that the voltage at the first node N1 may be ELVDD_L-|VTH|+a'*VDATA due to a charge sharing between the first node N1 and the second node N2 and a coupling of the program capacitor CPR. Herein, a' is CPR/(CST+CPR), were CPR and CST denote capacitances of the program capacitor and the storage capacitor, respectively.

In an exemplary embodiment, as shown in FIGS. 3 and 7, during a pre-emission anode initialization period BCB subsequent to the programming period PROGRAMMING, the first switching element T1 may be turned on, the second switching element T2 may be turned off, the third switching element T3 may be turned off, the first power voltage ELVDD may have the low level, the second power voltage ELVSS may have the high level and the initialization voltage VINIT may have the low level.

During the pre-emission anode initialization period BCB, the write gate signal GW[n] may have the high level and the compensation gate signal GC may have the high level.

During the pre-emission anode initialization period BCB, the anode electrode N3 of the organic light emitting element OLED may be initialized prior to emission so that an afterimage of the display image having a low grayscale value may be enhanced. In addition, during the pre-emission anode initialization period BCB, the first power voltage ELVDD has the low level so that the anode electrode N3 of the organic light emitting element OLED may be stably initialized.

In an exemplary embodiment, as shown in FIGS. 3 and 8, during an emission period EMISSION subsequent to the pre-emission anode initialization period BCB, the first switching element T1 may be turned on, the second switching element T2 may be turned off, the third switching element T3 may be turned off, the first power voltage ELVDD may have the high level, the second power voltage ELVSS may have the low level and the initialization voltage VINIT may have the high level.

During the emission period EMISSION, the write gate signal GW[n] may have the high level and the compensation gate signal GC may have the high level.

During the emission period EMISSION, the first switching element T1 is turned on, the first power voltage ELVDD has the high level and the second power voltage ELVSS has the low level so that a current path may be generated through the first switching element T1. During the emission period EMISSION, the organic light emitting element OLED may emit the light due to the current flowing through the first switching element T1.

According to an exemplary embodiment, as noted above, the pixel circuit includes three transistors T1, T2 and T3 and two capacitors CST and CPR so that the display panel 100 including the pixel circuit may have a high resolution.

In such an embodiment, the driving signal of the pixel circuit including three transistors T1, T2 and T3 and two capacitors CST and CPR may be controlled in a way such that the color difference between upper and lower portions and the crosstalk may be reduced or effectively prevented without increasing the number of the transistors in the pixel circuit. Thus, the display quality of the display panel 100 may be enhanced.

Figure 9:
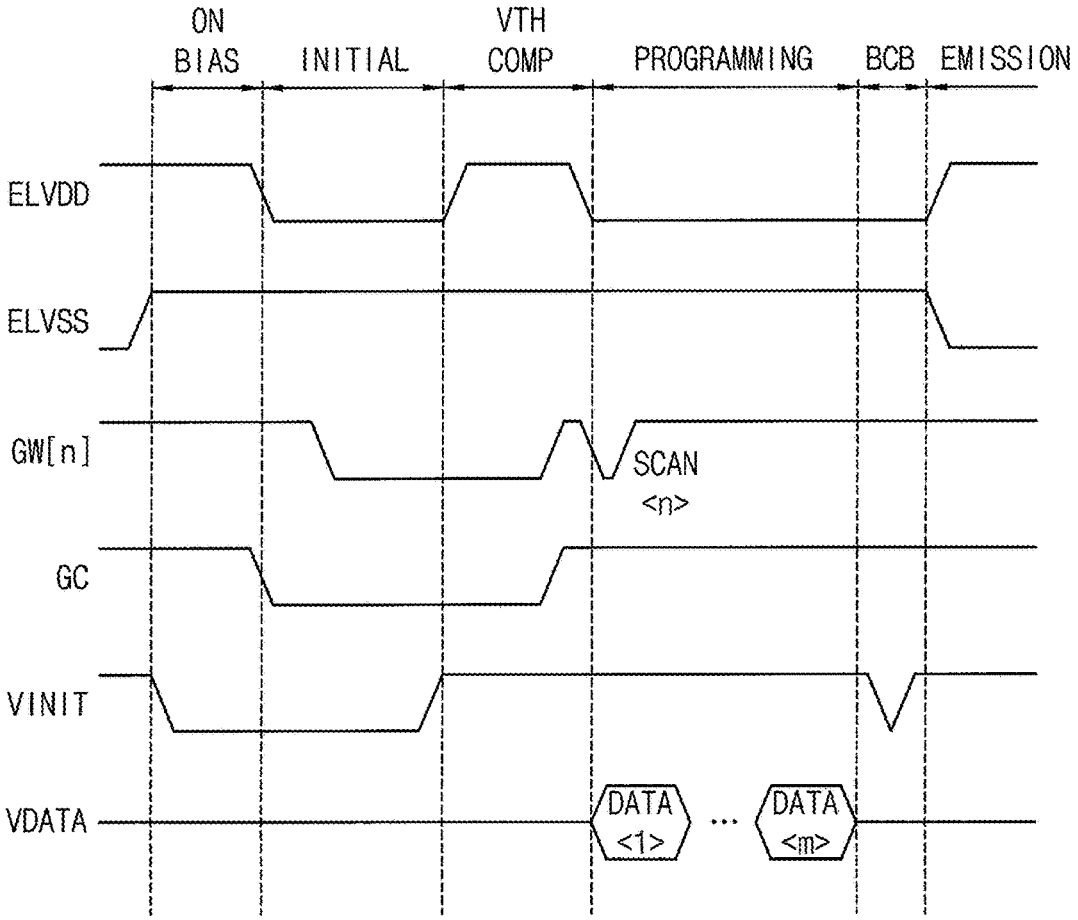
FIG. 9 is a timing diagram illustrating input signals applied to a pixel of a display apparatus according to an alternative exemplary embodiment of the invention.

FIG. 9 is a timing diagram illustrating input signals applied to a pixel of a display apparatus according to an alternative exemplary embodiment of the invention.

The exemplary embodiment of the pixel circuit and the display apparatus of FIG. 9 is substantially the same as the exemplary embodiment of the pixel circuit and the display apparatus o described above with reference to FIGS. 1 to 8 except for the timing of the write gate signal GW[n]. Thus, the same or like reference characters will be used to refer to the same or like elements as those of the exemplary embodiment of FIGS. 1 to 8, and any repetitive detailed description thereof will be omitted.

Referring to FIGS. 1, 2 and 4 to 9, an exemplary embodiment of the display panel 100 includes the plurality of pixels. Each pixel includes an organic light emitting element OLED.

In such an embodiment, as described above, a pixel of the pixels may include first to third pixel switching elements T1, T2 and T3, a storage capacitor CST, a program capacitor CPR and the organic light emitting element OLED, as shown in FIG. 2.

In an exemplary embodiment, the first to third switching elements T1, T2 and T3 may be P-type transistors. In one exemplary embodiment, for example, the first to third switching elements T1, T2 and T3 may be polysilicon thin film transistors.

In such an embodiment, as shown in FIG. 9, during an on bias period ON BIAS, the first switching element T1 may be turned on, the second switching element T2 may be turned off, the third switching element T3 may be turned off, the first power voltage ELVDD may have a high level, the second power voltage ELVSS may have a high level and the initialization voltage VINIT may have a low level.

During a first initialization period (a former part of INITIAL) subsequent to the on bias period ON BIAS, the first switching element T1 may be turned on, the second switching element T2 may be turned on, the third switching element T3 may be turned off, the first power voltage ELVDD may have a low level, the second power voltage ELVSS may have the high level and the initialization voltage VINIT may have the low level.

During a second initialization period (a latter part of INITIAL) subsequent to the first initialization period, the first switching element T1 may be turned on, the second switching element T2 may be turned on, the third switching element T3 may be turned on, the first power voltage ELVDD may have the low level, the second power voltage ELVSS may have the high level and the initialization voltage VINIT may have the low level.

In an exemplary embodiment, as shown in FIG. 9, during the first initialization period (the former part of INITIAL), the write gate signal GW[n] may have a high level and the compensation gate signal GC may have a low level. In such an embodiment, during the second initialization period (the latter part of INITIAL), the write gate signal GW[n] may have a low level and the compensation gate signal GC may have the low level.

During the first initialization period (the former part of INITIAL), the first switching element T1 is turned on and the second switching element T2 is turned on so that the second node N2 and the third node N3 may be initialized. During the second initialization period (the latter part of INITIAL), the first switching element T1 is turned on, the second switching element T2 is turned on and the third switching element T3 is turned on so that the first node N1, the second node N2, the third node N3 and the storage capacitor CST may be initialized.

According to an exemplary embodiment, the pixel circuit includes three transistors T1, T2 and T3 and two capacitors CST and CPR so that the display panel 100 including the pixel circuit may have a high resolution.

In such an embodiment, the driving signal of the pixel circuit including three transistors T1, T2 and T3 and two capacitors CST and CPR may be controlled in a way such that the color difference between upper and lower portions and the crosstalk may be reduced or effectively prevented without increasing the number of the transistors in the pixel circuit. Thus, the display quality of the display panel 100 may be enhanced.

Figure 10:
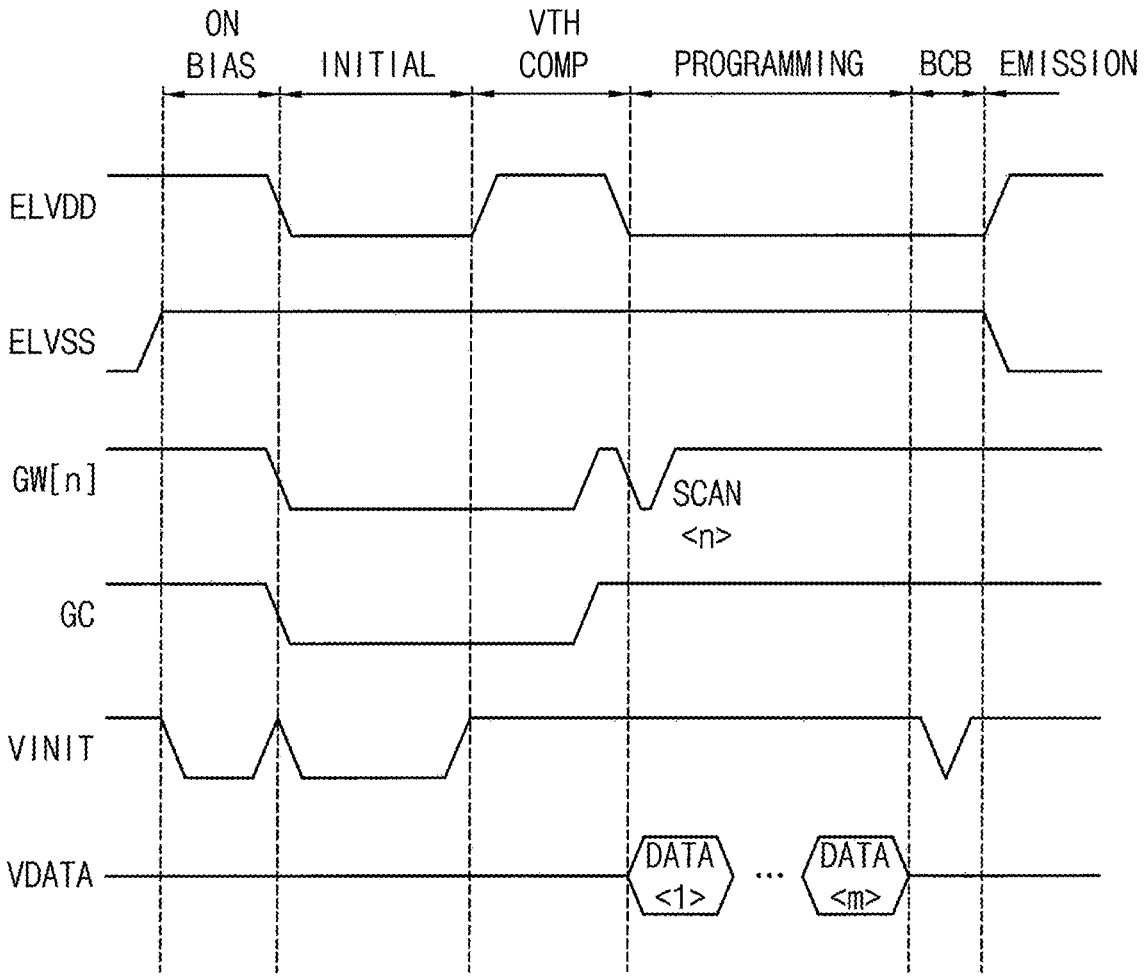
FIG. 10 is a timing diagram illustrating input signals applied to a pixel of a display apparatus according to another alternative exemplary embodiment of the invention.

FIG. 10 is a timing diagram illustrating input signals applied to a pixel of a display apparatus according to an exemplary embodiment of the invention.

An exemplary embodiment of the pixel circuit and the display apparatus of FIG. 10 is substantially the same as the exemplary embodiment of the pixel circuit and the display apparatus described above with reference to FIGS. 1 to 8 except for the timing of the initialization voltage VINIT. Thus, the same or like reference characters will be used to refer to the same or like element as those of the exemplary embodiment of FIGS. 1 to 8 and any repetitive detailed description thereof will be omitted.

Referring to FIGS. 1, 2, 4 to 8 and 10, an exemplary embodiment of the display panel 100 includes the plurality of pixels. Each pixel includes an organic light emitting element OLED.

In such an embodiment, as described above, a pixel of the pixels may include first to third pixel switching elements T1, T2 and T3, a storage capacitor CST, a program capacitor CPR and the organic light emitting element OLED.

In an exemplary embodiment, the first to third switching elements T1, T2 and T3 may be P-type transistors. In one exemplary embodiment, for example, the first to third switching elements T1, T2 and T3 may be polysilicon thin film transistors.

In such an embodiment, as shown in FIG. 10, during an on bias period ON BIAS, the first switching element T1 may be turned on, the second switching element T2 may be turned off, the third switching element T3 may be turned off, the first power voltage ELVDD may have a high level, the second power voltage ELVSS may have a high level and the initialization voltage VINIT may have a low level.

During an initialization period INITIAL subsequent to the on bias period ON BIAS, the first switching element T1 may be turned on, the second switching element T2 may be turned on, the third switching element T3 may be turned on, the first power voltage ELVDD may have a low level, the second power voltage ELVSS may have the high level and the initialization voltage VINIT may have the low level.

In an exemplary embodiment, as shown in FIG. 10, the initialization voltage VINIT may temporarily have a high level at a boundary between the on bias period ON BIAS and the initialization period INITIAL.

Accordingly, in such an embodiment, the voltage at the first node N1 may be further reduced instantaneously. Thus, the first node N1 may be further stably initialized.

According to an exemplary embodiment, as described above, the pixel circuit includes three transistors T1, T2 and T3 and two capacitors CST and CPR so that the display panel 100 including the pixel circuit may have the high resolution.

In such an embodiment, the driving signal of the pixel circuit including three transistors T1, T2 and T3 and two capacitors CST and CPR may be controlled in a way such that the color difference between upper and lower portions and the crosstalk may be reduced or effectively prevented without increasing the number of the transistors. Thus, the display quality of the display panel 100 may be enhanced.

Figure 11:
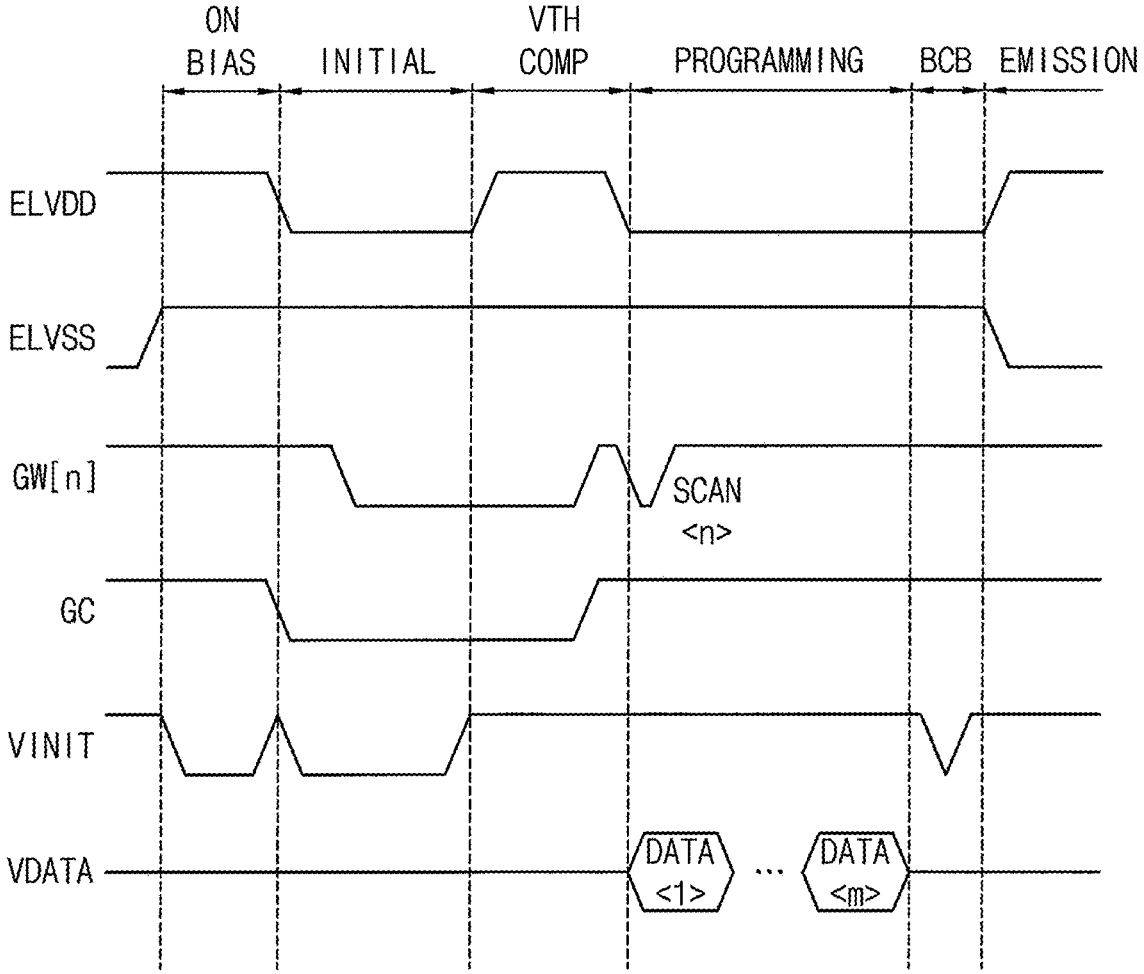
FIG. 11 is a timing diagram illustrating input signals applied to a pixel of a display apparatus according to another alternative exemplary embodiment of the invention.

FIG. 11 is a timing diagram illustrating input signals applied to a pixel of a display apparatus according to an exemplary embodiment of the invention.

An exemplary embodiment of the pixel circuit and the display apparatus of FIG. 11 is substantially the same as the exemplary embodiment of the pixel circuit and the display apparatus described above with reference to FIG. 10 except for the timing of the write gate signal GW[n]. Thus, the same reference characters will be used to refer to the same or like elements as those of the exemplary embodiment of FIG. 10 and any repetitive detailed description thereof will be omitted.

Referring to FIGS. 1, 2, 4 to 8 and 11, an exemplary embodiment of the display panel 100 includes the plurality of pixels. Each pixel includes an organic light emitting element OLED.

In such an embodiment, as described above, a pixel of the pixels may include first to third pixel switching elements T1, T2 and T3, a storage capacitor CST, a program capacitor CPR and the organic light emitting element OLED.

In an exemplary embodiment, the first to third switching elements T1, T2 and T3 may be P-type transistors. In one exemplary embodiment, for example, the first to third switching elements T1, T2 and T3 may be polysilicon thin film transistors.

In such an embodiment, as shown in FIG. 11, during an on bias period ON BIAS, the first switching element T1 may be turned on, the second switching element T2 may be turned off, the third switching element T3 may be turned off, the first power voltage ELVDD may have a high level, the second power voltage ELVSS may have a high level and the initialization voltage VINIT may have a low level.

During a first initialization period (a former part of INITIAL) subsequent to the on bias period ON BIAS, the first switching element T1 may be turned on, the second switching element T2 may be turned on, the third switching element T3 may be turned off, the first power voltage ELVDD may have a low level, the second power voltage ELVSS may have the high level and the initialization voltage VINIT may have the low level.

During a second initialization period (a latter part of INITIAL) subsequent to the first initialization period, the first switching element T1 may be turned on, the second switching element T2 may be turned on, the third switching element T3 may be turned on, the first power voltage ELVDD may have a low level, the second power voltage ELVSS may have the high level and the initialization voltage VINIT may have the low level.

In an exemplary embodiment, as shown in FIG. 11, during the first initialization period (the former part of INITIAL), the write gate signal GW[n] may have a high level and the compensation gate signal GC may have a low level. In such an embodiment, during the second initialization period (the latter part of INITIAL), the write gate signal GW[n] may have a low level and the compensation gate signal GC may have the low level.

During the first initialization period (the former part of INITIAL), the first switching element T1 is turned on and the second switching element T2 is turned on so that the second node N2 and the third node N3 may be initialized. During the second initialization period (the latter part of INITIAL), the first switching element T1 is turned on, the second switching element T2 is turned on and the third switching element T3 is turned on so that the first node N1, the second node N2, the third node N3 and the storage capacitor CST may be initialized.

In an exemplary embodiment, as described above, the initialization voltage VINIT may temporarily have a high level at a boundary between the on bias period ON BIAS and the first initialization period (the former part of INITIAL).

Accordingly, in such an embodiment, the voltage at the first node N1 may be further reduced instantaneously. Thus, the first node N1 may be further stably initialized.

According to an exemplary embodiment, the pixel circuit includes three transistors T1, T2 and T3 and two capacitors CST and CPR so that the display panel 100 including the pixel circuit may have the high resolution.

In such an embodiment, the driving signal of the pixel circuit including three transistors T1, T2 and T3 and two capacitors CST and CPR may be controlled in a way such that the color difference between upper and lower portions and the crosstalk may be reduced or effectively prevented without increasing the number of the transistors. Thus, the display quality of the display panel 100 may be enhanced.

Figure 12:
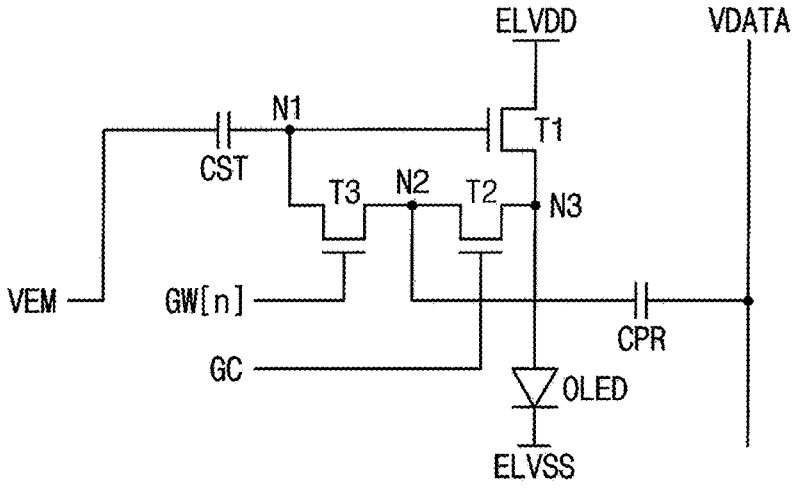
FIG. 12 is a circuit diagram illustrating a pixel of a display panel according to an alternative exemplary embodiment of the invention.
Figure 13:
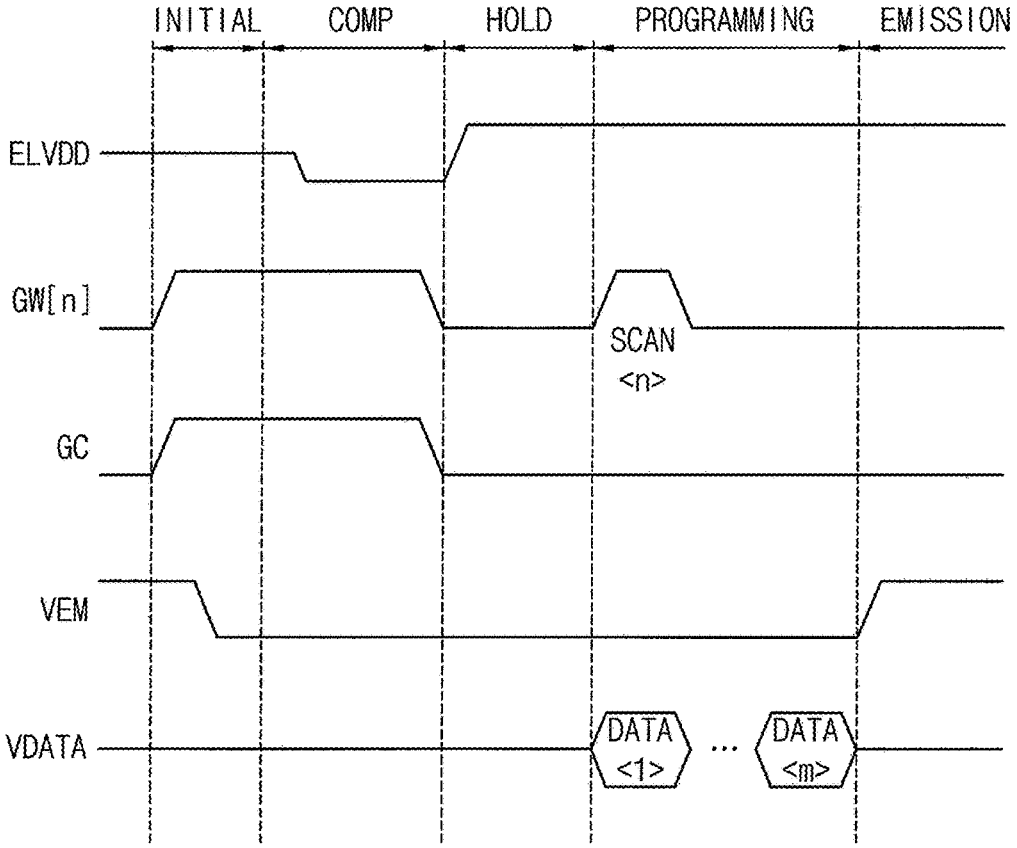
FIG. 13 is a timing diagram illustrating input signals applied to the pixel of FIG. 12.
Figure 14:
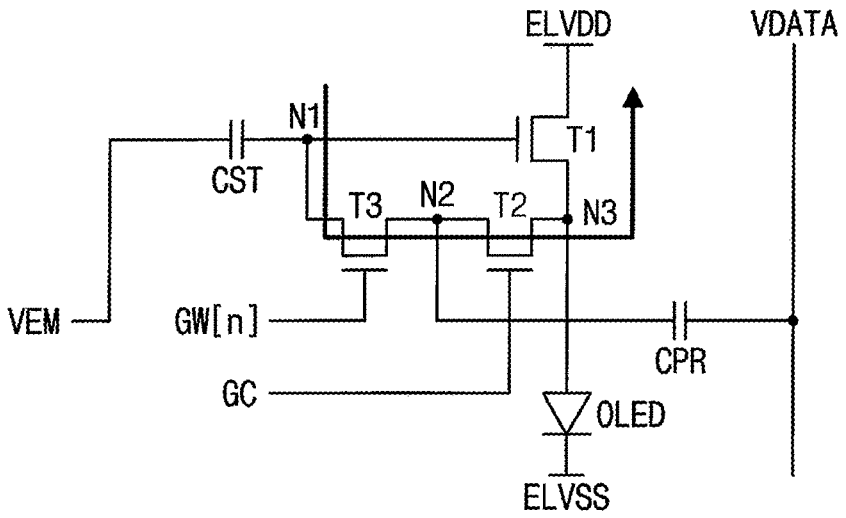
FIG. 14 is a circuit diagram illustrating the pixel of FIG. 12 in an initialization period and a threshold voltage compensation period of FIG. 13.
Figure 15:
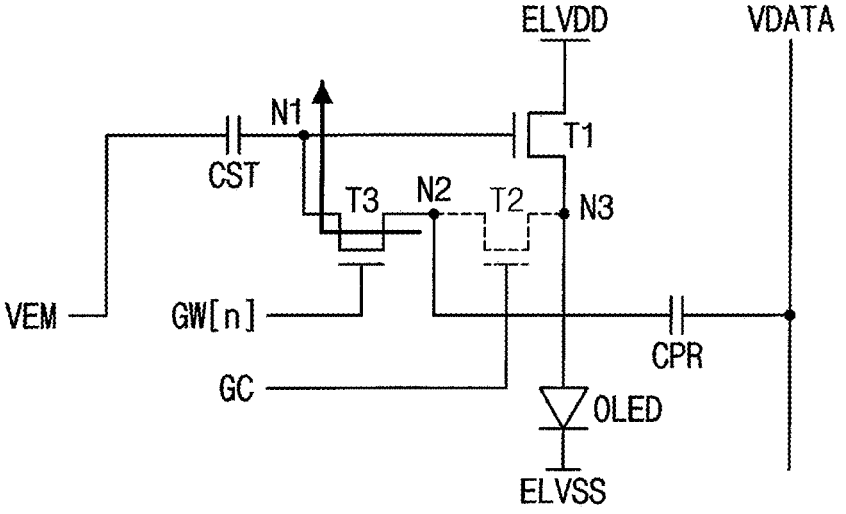
FIG. 15 is a circuit diagram illustrating the pixel of FIG. 12 in a programming period of FIG. 13.
Figure 16:
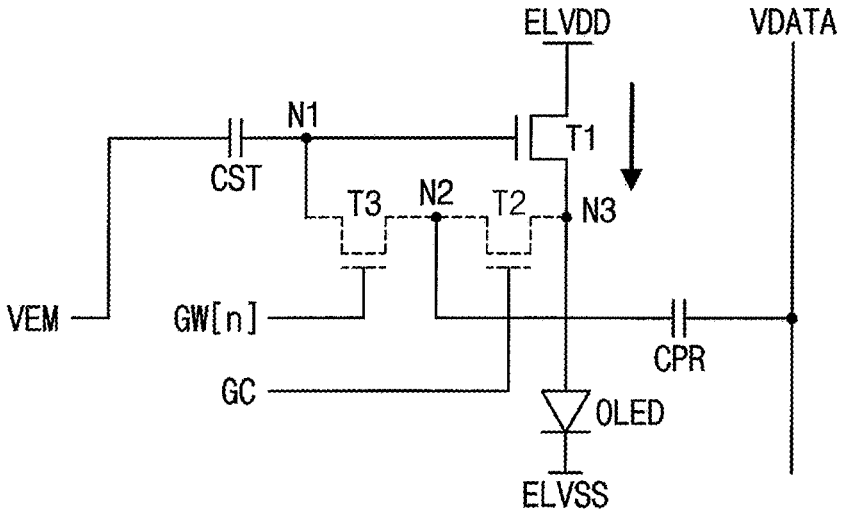
FIG. 16 is a circuit diagram illustrating the pixel FIG. 12 in an emission period of FIG. 13.

FIG. 12 is a circuit diagram illustrating a pixel of a display panel 100 according to an alternative exemplary embodiment of the invention. FIG. 13 is a timing diagram illustrating input signals applied to the pixel of FIG. 12. FIG. 14 is a circuit diagram illustrating the pixel of FIG. 12 in an initialization period INITIAL and a threshold voltage compensation period COMP of FIG. 13. FIG. 15 is a circuit diagram illustrating the pixel FIG. 12 in a programming period PROGRAMMING of FIG. 13. FIG. 16 is a circuit diagram illustrating the pixel of FIG. 12 in an emission period EMISSION of FIG. 13.

An exemplary embodiment of the pixel circuit and the display apparatus of FIGS. 12 to 16 is substantially the same as the exemplary embodiment of the pixel circuit and the display apparatus described above with reference to FIGS. 1 to 8 except that the first to third switching elements are N-type transistors and except for the timing of the input signals. Thus, the same reference characters will be used to refer to the same or like elements as those of the exemplary embodiment of FIGS. 1 to 8 and any repetitive detailed description thereof will be omitted.

Referring to FIGS. 1 and 12 to 16, an exemplary embodiment of the display panel 100 includes the plurality of pixels. Each pixel includes an organic light emitting element OLED.

In such an embodiment, as shown in FIGS. 12 and 13, the pixels receive a write gate signal GW, a compensation gate signal GC, the data voltage VDATA and an initialization voltage VEM, a first power voltage ELVDD and a second power voltage ELVSS and the organic light emitting elements OLED of the pixels emit light corresponding to the level of the data voltage VDATA to display the image.

In an exemplary embodiment, the write gate signal GW[n] may be a local signal having a predetermined phase for a corresponding pixel row, e.g., an n-th pixel row. In such an embodiment, the compensation gate signal GC may be a common signal commonly applied to all of the pixel rows.

In such an embodiment, as described above, a pixel of the pixels may include first to third pixel switching elements T1, T2 and T3, a storage capacitor CST, a program capacitor CPR and the organic light emitting element OLED.

In the present exemplary embodiment, the first to third switching elements T1, T2 and T3 may be N-type transistors. In one exemplary embodiment, for example, the first to third switching elements T1, T2 and T3 may be oxide thin film transistors.

The first switching element T1 may include a control electrode connected to a first node N1, an input electrode which receives the first power voltage ELVDD and an output electrode connected to a third node N3. The control electrode of the first switching element T1 may be a gate electrode, the input electrode of the first switching element T1 may be a source electrode, and the output electrode of the first switching element T1 may be a drain electrode.

The second switching element T2 may include a control electrode which receives the compensation gate signal GC, an input electrode connected to a second node N2 and an output electrode connected to the third node N3. The control electrode of the second switching element T2 may be a gate electrode, the input electrode of the second switching element T2 may be a source electrode, and the output electrode of the second switching element T2 may be a drain electrode.

The third switching element T3 may include a control electrode which receives the write gate signal GW, an input electrode connected to the first node N1 and an output electrode connected to the second node N2. The control electrode of the third switching element T3 may be a gate electrode, the input electrode of the third switching element T3 may be a source electrode, and the output electrode of the third switching element T3 may be a drain electrode.

The storage capacitor CST may include a first electrode which receives the initialization voltage VEM and a second electrode connected to the first node N1.

The program capacitor CPR may include a first electrode which receives the data voltage VDATA and a second electrode connected to the second node N2.

The organic light emitting element OLED may include a first electrode connected to the third node N3 and a second electrode which receives the second power voltage ELVSS. The first electrode of the organic light emitting element OLED may be an anode electrode. The second electrode of the organic light emitting element OLED may be a cathode electrode.

In an exemplary embodiment, the second power voltage ELVSS may be a direct-current ("DC") voltage. In one exemplary embodiment, for example, the second power voltage ELVSS may have a low level.

In such an embodiment, as shown in FIGS. 13 and 14, during an initialization period INITIAL, the first switching element T1 may be turned on, the second switching element T2 may be turned on, the third switching element T3 may be turned on and the first power voltage ELVDD may have an intermediate level between a high level and a low level.

In the initialization period INITIAL, the initial voltage VEM may be decrease from a high level to a low level. During the initialization period INITIAL, the write gate signal GW[n] may have a high level and the compensation gate signal GC may have a high level.

During the initialization period INITIAL, the first node N1 connected to the control electrode of the first switching element T1 may be initialized using the intermediate level of the first power voltage ELVDD. During the initialization period INITIAL, the voltage at the first node N1 may be ELVDD_INT+|VTH|. Herein, ELVDD_INT denotes the intermediate level of the first power voltage ELVDD.

In such an embodiment, as shown in FIGS. 13 and 14, during a threshold voltage compensation period COMP subsequent to the initialization period INITIAL, the first switching element T1 may be turned on, the second switching element T2 may be turned on, the third switching element T3 may be turned on, the first power voltage ELVDD may have the low level, and the initialization voltage VEM may have the low level.

During the threshold voltage compensation period COMP, the write gate signal GW[n] may have the high level and the compensation gate signal GC may have the high level.

During the threshold voltage compensation period COMP, the first power voltage ELVDD decreases from the intermediate level to the low high level so that the threshold voltage (denoted by |VTH|) of the first switching element T1 may be compensated using a diode connection of the first switching element T1. During the threshold voltage compensation period COMP, the voltage at the first node N1 may be ELVDD_L+|VTH|. Herein, ELVDD_L denotes the low level of the first power voltage ELVDD.

In such an embodiment, as shown in FIGS. 13 and 15, during a programming period PROGRAMMING subsequent to the threshold voltage compensation period COMP, the first switching element T1 may be turned on, the second switching element T2 may be turned off, the third switching element T3 may be turned on, the first power voltage ELVDD may have the high level, and the initialization voltage VEM may have the low level.

During the programming period PROGRAMMING, the write gate signal GW[n] may sequentially have a high level according to scanning of the pixels in pixel rows in the display panel 100 and the compensation gate signal GC may have the low level.

During the programming period PROGRAMMING, the data voltage VDATA is applied to the pixel through the data line DL.

During the programming period PROGRAMMING, the third switching element T3 may be turned on so that the voltage at the first node N1 may be ELVDD_L+|VTH|+a'*VDATA, where a' is CPR/(CST+CPR), due to a charge sharing between the first node N1 and the second node N2 and a coupling of the program capacitor CPR.

In such an embodiment, as shown in FIGS. 13 and 16, during an emission period EMISSION subsequent to the programming period PROGRAMMING, the first switching element T1 may be turned on, the second switching element T2 may be turned off, the third switching element T3 may be turned off, the first power voltage ELVDD may have the high level, and the initialization voltage VEM may have the high level.

During the emission period EMISSION, the write gate signal GW[n] may have the low level and the compensation gate signal GC may have the low level.

During the emission period EMISSION, the first switching element T1 is turned on, the first power voltage ELVDD has the high level and the second power voltage ELVSS has the low level so that a current path may be generated through the first switching element T1. During the emission period EMISSION, the organic light emitting element OLED may emit the light due to the current flowing through the first switching element T1.

According to an exemplary embodiment, as described above, the pixel circuit includes three transistors T1, T2 and T3 and two capacitors CST and CPR so that the display panel 100 including the pixel circuit may have the high resolution.

In such an embodiment, the driving signal of the pixel circuit including three transistors T1, T2 and T3 and two capacitors CST and CPR may be controlled in a way such that the color difference between upper and lower portions and the crosstalk may be reduced or prevented without increasing the number of the transistors in the pixel circuit. Thus, the display quality of the display panel 100 may be enhanced.

Figure 17:
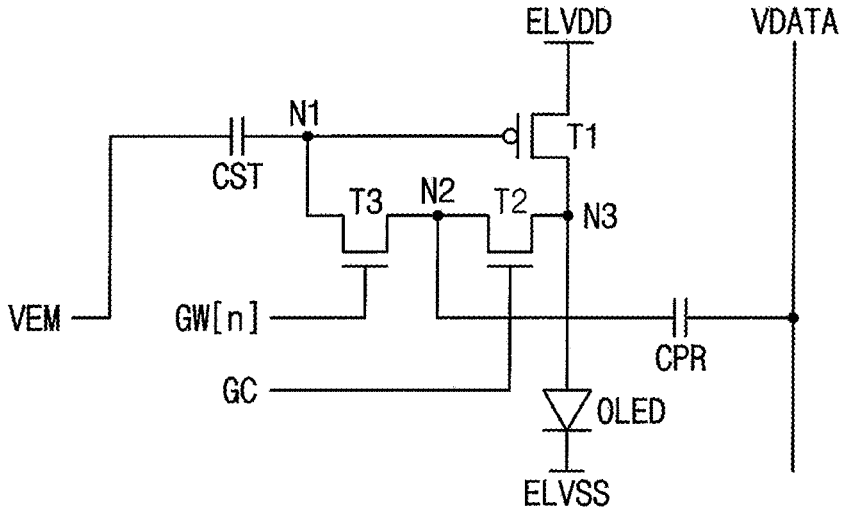
FIG. 17 is a circuit diagram illustrating a pixel of a display panel according to another alternative exemplary embodiment of the invention.

FIG. 17 is a circuit diagram illustrating a pixel of a display apparatus according to an exemplary embodiment of the invention.

An exemplary embodiment of the pixel circuit and the display apparatus of FIG. 17 is substantially the same as the exemplary embodiment of the pixel circuit and the display apparatus described above with reference to FIGS. 1 to 8 except that the second switching element and the third switching element among the first to third switching elements are N-type transistors. Thus, the same or like reference characters will be used to refer to the same or like elements as those of the exemplary embodiment of FIGS. 1 to 8 and any repetitive detailed description thereof will be omitted.

Referring to FIGS. 1, 3 to 8 and 17, an exemplary embodiment of the display panel 100 includes the plurality of pixels. Each pixel includes an organic light emitting element OLED.

The pixels receive a write gate signal GW, a compensation gate signal GC, the data voltage VDATA and an initialization voltage VEM, a first power voltage ELVDD and a second power voltage ELVSS and the organic light emitting elements OLED of the pixels emit light corresponding to the level of the data voltage VDATA to display the image.

In an exemplary embodiment, the write gate signal GW[n] may be a local signal having a predetermined phase for a corresponding pixel row, e.g., an n-th pixel row. In such an embodiment, the compensation gate signal GC may be a common signal commonly applied to all of the pixel rows.

In such an embodiment, as described above, a pixel of the pixels may include first to third pixel switching elements T1, T2 and T3, a storage capacitor CST, a program capacitor CPR and the organic light emitting element OLED.

In an exemplary embodiment, the first switching element T1 may be a P-type transistor. In one exemplary embodiment, for example, the first switching element T1 may be a polysilicon thin film transistor. In the present exemplary embodiment, the second and third switching elements T2 and T3 may be N-type transistors. In one exemplary embodiment, for example, the second and third switching elements T2 and T3 may be oxide thin film transistors.

The first switching element T1 is the P-type transistor so that the pre-emission anode initialization may be operated and a luminance change in a high temperature may be effectively prevented.

The second and third switching elements T2 and T3 are the N-type transistors so that the current leakage at the second and third switching elements T2 and T3 may be effectively prevented.

According to an exemplary embodiment, the pixel circuit includes three transistors T1, T2 and T3 and two capacitors CST and CPR so that the display panel 100 including the pixel circuit may have the high resolution.

In such an embodiment, the driving signal of the pixel circuit including three transistors T1, T2 and T3 and two capacitors CST and CPR may be controlled in a way such that the color difference between upper and lower portions and the crosstalk may be reduced or effectively prevented without increasing the number of the transistors in the pixel circuit. Thus, the display quality of the display panel 100 may be enhanced.

Figure 18:
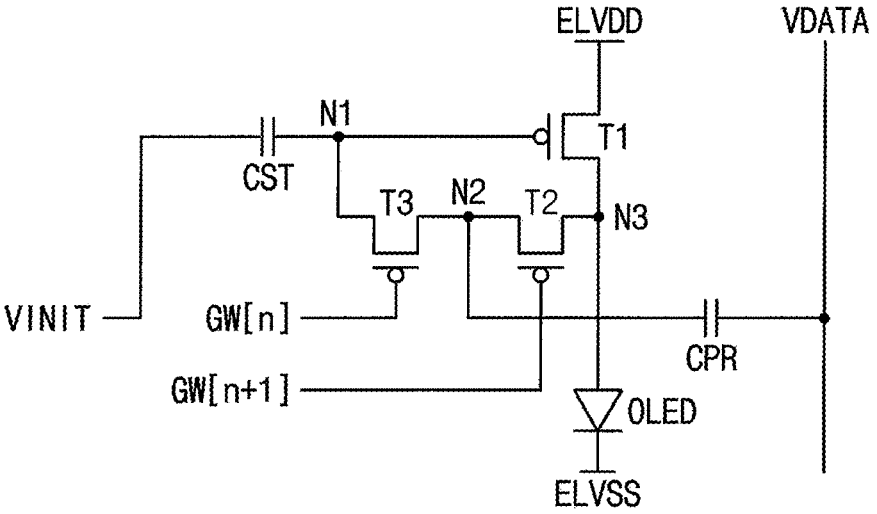
FIG. 18 is a circuit diagram illustrating a pixel of a display panel according to another alternative exemplary embodiment of the invention.

FIG. 18 is a circuit diagram illustrating a pixel of a display apparatus according to an exemplary embodiment of the invention.

An exemplary embodiment of the pixel circuit and the display apparatus of FIG. 18 is substantially the same as the exemplary embodiment of the pixel circuit and the display apparatus described above with reference to FIGS. 1 to 8 except for the compensation gate signal. Thus, the same or like reference characters will be used to refer to the same or like elements as those of the exemplary embodiment of FIGS. 1 to 8 and any repetitive detailed description thereof will be omitted.

Referring to FIGS. 1, 3 to 8 and 18, an exemplary embodiment of the display panel 100 includes the plurality of pixels. Each pixel includes an organic light emitting element OLED.

The pixels receive a write gate signal GW, a compensation gate signal GC, the data voltage VDATA and an initialization voltage VINIT, a first power voltage ELVDD and a second power voltage ELVSS and the organic light emitting elements OLED of the pixels emit light corresponding to the level of the data voltage VDATA to display the image.

In an exemplary embodiment, the write gate signal GW[n] may be a local signal having a predetermined phase for a corresponding pixel row, e.g., an n-th pixel row. In such an embodiment, the compensation gate signal GC may be a predetermined phase for a corresponding pixel row, e.g., an n-th pixel row.

In one exemplary embodiment, for example, the compensation gate signal GC may be a write gate signal of a different pixel or another pixel. In one exemplary embodiment, for example, a write gate signal GW[n+1] of a pixel disposed in an (n+1)-th pixel row may be used as the compensation gate signal GC of a pixel disposed in an n-th pixel row. Alternatively, a write gate signal GW[n] of a pixel disposed in the (n)-th pixel row may be used as the compensation gate signal GC of a pixel disposed in the n-th pixel row. Alternatively, one of write gate signals GW of pixels may be used as the compensation gate signal GC of a pixel disposed in the n-th pixel row.

In such an embodiment, as described above, a pixel of the pixels may include first to third pixel switching elements T1, T2 and T3, a storage capacitor CST, a program capacitor CPR and the organic light emitting element OLED.

In an exemplary embodiment, the first to third switching elements T1, T2 and T3 may be P-type transistors. In one exemplary embodiment, for example, the first to third switching elements T1, T2 and T3 may be polysilicon thin film transistors.

According to an exemplary embodiment, as described above, the pixel circuit includes three transistors T1, T2 and T3 and two capacitors CST and CPR so that the display panel 100 including the pixel circuit may have the high resolution.

In such an embodiment, the driving signal of the pixel circuit including three transistors T1, T2 and T3 and two capacitors CST and CPR may be controlled in a way such that so that the color difference between upper and lower portions and the crosstalk may be reduced or effectively prevented without increasing the number of the transistors in the pixel circuit. Thus, the display quality of the display panel 100 may be enhanced.

Figure 19:
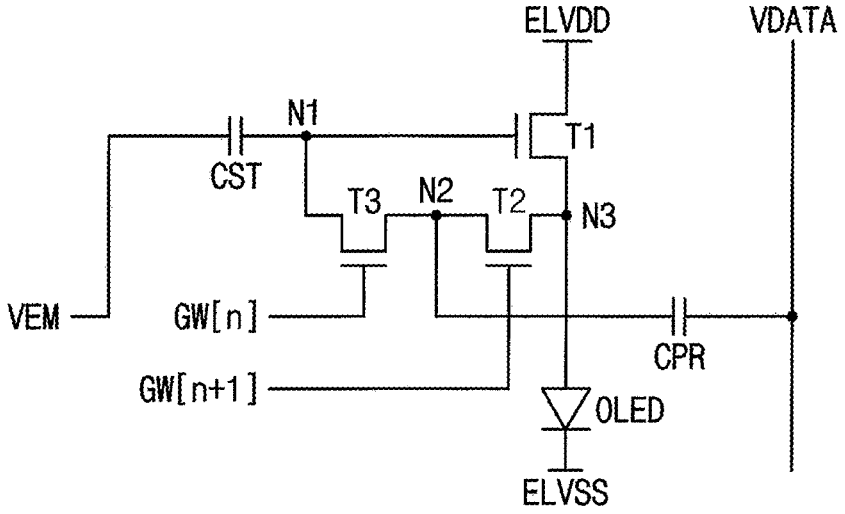
FIG. 19 is a circuit diagram illustrating a pixel of a display panel according to another alternative exemplary embodiment of the invention.

FIG. 19 is a circuit diagram illustrating a pixel of a display apparatus according to an exemplary embodiment of the invention.

An exemplary embodiment of the pixel circuit and the display apparatus of FIG. 19 is substantially the same as the exemplary embodiment of the pixel circuit and the display apparatus described above with reference to FIGS. 12 to 16 except for the compensation gate signal. Thus, the same or like reference characters will be used to refer to the same or like elements as those of the exemplary embodiment of FIGS. 12 to 16 and any repetitive detailed description thereof will be omitted.

Referring to FIGS. 1, 13 to 16 and 19, an exemplary embodiment of the display panel 100 includes the plurality of pixels. Each pixel includes an organic light emitting element OLED.

The pixels receive a write gate signal GW, a compensation gate signal GC, the data voltage VDATA and an initialization voltage VEM, a first power voltage ELVDD and a second power voltage ELVSS and the organic light emitting elements OLED of the pixels emit light corresponding to the level of the data voltage VDATA to display the image.

In an exemplary embodiment, the write gate signal GW[n] may be a local signal having a predetermined phase for a corresponding pixel row, e.g., an n-th pixel row. In such an embodiment, the compensation gate signal GC may be a predetermined phase for a corresponding pixel row, e.g., an n-th pixel row.

In one exemplary embodiment, for example, the compensation gate signal GC may be a write gate signal of a different pixel or another pixel. In one exemplary embodiment, for example, a write gate signal GW[n+1] of a pixel disposed in an (n+1)-th pixel row may be used as the compensation gate signal GC of a pixel disposed in an n-th pixel row. Alternatively, a write gate signal GW[n] of a pixel disposed in the (n)-th pixel row may be used as the compensation gate signal GC of a pixel disposed in the n-th pixel row. Alternatively, one of write gate signals GW of pixels may be used as the compensation gate signal GC of a pixel disposed in the n-th pixel row.

In such an embodiment, as described above, a pixel of the pixels may include first to third pixel switching elements T1, T2 and T3, a storage capacitor CST, a program capacitor CPR and the organic light emitting element OLED.

In an exemplary embodiment, the first to third switching elements T1, T2 and T3 may be N-type transistors. In one exemplary embodiment, for example, the first to third switching elements T1, T2 and T3 may be oxide thin film transistors.

According to an exemplary embodiment, the pixel circuit includes three transistors T1, T2 and T3 and two capacitors CST and CPR so that the display panel 100 including the pixel circuit may have the high resolution.

In such an embodiment, the driving signal of the pixel circuit including three transistors T1, T2 and T3 and two capacitors CST and CPR may be controlled in a way such that the color difference between upper and lower portions and the crosstalk may be reduced or effectively prevented without increasing the number of the transistors in the pixel circuit. Thus, the display quality of the display panel 100 may be enhanced.

According to exemplary embodiments of the invention as described herein, the display panel, in which the pixel circuit including three transistors and two capacitors, may have the high resolution and the display quality of the display panel may be enhanced.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A pixel circuit comprising:

a first switching element comprising a control electrode connected to a first node, an input electrode which receives a first power voltage and an output electrode connected to a third node;

a second switching element comprising a control electrode which receives a compensation gate signal, an input electrode connected to a second node and an output electrode connected to the third node;

a third switching element comprising a control electrode which receives a write gate signal, an input electrode connected to the first node and an output electrode connected to the second node;

a storage capacitor comprising a first electrode which receives an initialization voltage and a second electrode connected to the first node;

a program capacitor comprising a first electrode which receives a data voltage and a second electrode connected to the second node; and an organic light emitting element comprising a first electrode connected to the third node and a second electrode which receives a second power voltage.

2. The pixel circuit of claim 1, wherein the first switching element, the second switching element and the third switching element are P-type transistors.

3. The pixel circuit of claim 2, wherein, during an on bias period, the first switching element is turned on, the second switching element is turned off, the third switching element is turned off, the first power voltage has a high level, the second power voltage has a high level, and the initialization voltage has a low level.

4. The pixel circuit of claim 3, wherein, during an initialization period subsequent to the on bias period, the first switching element is turned on, the second switching element is turned on, the third switching element is turned on, the first power voltage has a low level, the second power voltage has the high level, and the initialization voltage has the low level.

5. The pixel circuit of claim 4, wherein, during a threshold voltage compensation period subsequent to the initialization period, the first switching element is turned on, the second switching element is turned on, the third switching element is turned on, the first power voltage has the high level, the second power voltage has the high level, and the initialization voltage has a high level.

6. The pixel circuit of claim 5, wherein, during a programming period subsequent to the threshold voltage compensation period, the first switching element is turned on, the second switching element is turned off, the third switching element is turned on, the first power voltage has the low level, the second power voltage has the high level, and the initialization voltage has the high level.

7. The pixel circuit of claim 6, wherein, during a pre-emission anode initialization period subsequent to the programming period, the first switching element is turned on, the second switching element is turned off, the third switching element is turned off, the first power voltage has the low level, the second power voltage has the high level, and the initialization voltage has the low level.

8. The pixel circuit of claim 7, wherein, during an emission period subsequent to the pre-emission anode initialization period, the first switching element is turned on, the second switching element is turned off, the third switching element is turned off, the first power voltage has the high level, the second power voltage has the low level, and the initialization voltage has the high level.

9. The pixel circuit of claim 3, wherein, during a first initialization period subsequent to the on bias period, the first switching element is turned on, the second switching element is turned on, the third switching element is turned off, the first power voltage has a low level, the second power voltage has the high level, and the initialization voltage has the low level, and wherein, during a second initialization period subsequent to the first initialization period, the first switching element is turned on, the second switching element is turned on, the third switching element is turned on, the first power voltage has the low level, the second power voltage has the high level, and the initialization voltage has the low level.

10. The pixel circuit of claim 3, wherein during an initialization period subsequent to the on bias period, the first switching element is turned on, the second switching element is turned on, the third switching element is turned on, the first power voltage has a low level, the second power voltage has the high level, and the initialization voltage has the low level, and wherein the initialization voltage temporarily has a high level at a boundary between the on bias period and the initialization period.

11. The pixel circuit of claim 3, wherein during a first initialization period subsequent to the on bias period, the first switching element is turned on, the second switching element is turned on, the third switching element is turned off, the first power voltage has a low level, the second power voltage has the high level, and the initialization voltage has the low level, wherein during a second initialization period subsequent to the first initialization period, the first switching element is turned on, the second switching element is turned on, the third switching element is turned on, the first power voltage has the low level, the second power voltage has the high level, and the initialization voltage has the low level, and wherein the initialization voltage temporarily has a high level at a boundary between the on bias period and the first initialization period.

12. The pixel circuit of claim 2, wherein the compensation gate signal is a write gate signal of a different pixel.

13. The pixel circuit of claim 1, wherein the first switching element, the second switching element and the third switching element are N-type transistors.

14. The pixel circuit of claim 13, wherein during an initialization period, the first switching element is turned on, the second switching element is turned on, the third switching element is turned on, and the first power voltage has an intermediate level between a high level and a low level.

15. The pixel circuit of claim 14, wherein, during a threshold voltage compensation period subsequent to the initialization period, the first switching element is turned on, the second switching element is turned on, the third switching element is turned on, the first power voltage has the low level, and the initialization voltage has a low level.

16. The pixel circuit of claim 15, wherein, during a programming period subsequent to the threshold voltage compensation period, the first switching element is turned on, the second switching element is turned off, the third switching element is turned on, the first power voltage has the high level, and the initialization voltage has the low level.

17. The pixel circuit of claim 16, wherein, during an emission period subsequent to the programming period, the first switching element is turned on, the second switching element is turned off, the third switching element is turned off, the first power voltage has the high level, and the initialization voltage has a high level.

18. The pixel circuit of claim 13, wherein the compensation gate signal is a write gate signal of a different pixel.

19. The pixel circuit of claim 1, wherein the first switching element is a P-type transistor, and wherein the second switching element and the third switching element are N-type transistors.

20. A display apparatus comprising:

a display panel comprising a plurality of pixels;

a gate driver which outputs a write gate signal to the pixels; and a data driver which outputs a data voltage to the pixels, wherein a pixel of the pixels comprises:

a first switching element comprising a control electrode connected to a first node, an input electrode which receives a first power voltage and an output electrode connected to a third node;

a second switching element comprising a control electrode which receives a compensation gate signal, an input electrode connected to a second node and an output electrode connected to the third node;

a third switching element comprising a control electrode which receives the write gate signal, an input electrode connected to the first node and an output electrode connected to the second node;

a storage capacitor comprising a first electrode which receives an initialization voltage and a second electrode connected to the first node;

a program capacitor comprising a first electrode which receives the data voltage and a second electrode connected to the second node; and an organic light emitting element comprising a first electrode connected to the third node and a second electrode which receives a second power voltage.

* * * * *